US010981385B2

(12) United States Patent
Suzuki et al.

(10) Patent No.: US 10,981,385 B2
(45) Date of Patent: Apr. 20, 2021

(54) CLEANING LIQUID FOR AQUEOUS INK

(71) Applicant: KAO CORPORATION, Tokyo (JP)

(72) Inventors: Takayuki Suzuki, Barcelona (ES); Hirotaka Takeno, Wakayama (JP)

(73) Assignee: KAO CORPORATION, Tokyo (JP)

( * ) Notice: Subject to any disclaimer, the term of this patent is extended or adjusted under 35 U.S.C. 154(b) by 21 days.

(21) Appl. No.: 16/473,398

(22) PCT Filed: Dec. 26, 2017

(86) PCT No.: PCT/JP2017/046765

§ 371 (c)(1),
(2) Date: Jun. 25, 2019

(87) PCT Pub. No.: WO2018/124124

PCT Pub. Date: Jul. 5, 2018

(65) Prior Publication Data

US 2019/0329553 A1 Oct. 31, 2019

(30) Foreign Application Priority Data

Dec. 28, 2016 (JP) ..... JP2016-255726

(51) Int. Cl.

| | |
|---|---|
| ***B41J 2/165*** | (2006.01) |
| ***C11D 3/37*** | (2006.01) |
| ***C11D 3/40*** | (2006.01) |
| ***C11D 3/43*** | (2006.01) |

(52) U.S. Cl.

CPC ..... *B41J 2/165* (2013.01); *C11D 3/3707* (2013.01); *C11D 3/40* (2013.01); *C11D 3/43* (2013.01)

(58) Field of Classification Search

CPC ... B41J 2/01; B41J 2/211; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/1623; B41J 2202/00; B41J 2202/03; B41J 2/14201; B41J 2/045; B41J 11/0015; B41J 11/002; B41J 2/04581; B41J 2/055; B41J 2/161; B41J 2/19; B41J 15/04; B41J 2/16538; B41J 2002/16502; B41J 29/02; B41J 2/17513; B41J 2/17509; B41J 29/13; B41J 2/17553; B41J 2/1606; B41J 2/1642; B41J 2/1609; B41J 2/164; B41J 2/162; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106; C09D 11/326; C09D 11/107; C09D 11/03; C09D 11/037; C09D 11/033

See application file for complete search history.

(56) References Cited

U.S. PATENT DOCUMENTS

| | | | | |
|---|---|---|---|---|
| 2004/0043340 | A1* | 3/2004 | Seki | G03C 7/3046 430/463 |
| 2005/0018023 | A1 | 1/2005 | Momose et al. | |
| 2009/0042762 | A1* | 2/2009 | Zenfuku | C11D 11/0029 510/175 |
| 2011/0061678 | A1 | 3/2011 | Koshiyama et al. | |
| 2011/0224117 | A1 | 9/2011 | Mitsuishi et al. | |
| 2014/0092168 | A1* | 4/2014 | Ito | B41J 2/16552 347/21 |
| 2014/0107007 | A1* | 4/2014 | Sao | C09D 11/40 510/170 |
| 2015/0077465 | A1 | 3/2015 | Haijima | |
| 2017/0369725 | A1 | 12/2017 | Mitsuyoshi et al. | |

FOREIGN PATENT DOCUMENTS

| | | | |
|---|---|---|---|
| CN | 102171324 | A | 8/2011 |
| CN | 104349901 | A | 2/2015 |
| EP | 2 891 691 | A1 | 7/2015 |
| JP | 62-135598 | A | 6/1987 |
| JP | 5-171092 | A | 7/1993 |
| JP | 9-31490 | A | 2/1997 |
| JP | 9-72894 | A | 3/1997 |
| JP | 2006-28291 | A | 2/2006 |
| JP | 2010-77346 | A | 4/2010 |
| JP | 2013-241552 | A | 12/2013 |
| WO | WO 2010434582 | A1 | 7/2010 |
| WO | WO 2013180074 | A1 | 12/2013 |
| WO | WO 2014/034662 | A1 | 3/2014 |
| WO | WO 2016/104294 | A1 | 6/2016 |

OTHER PUBLICATIONS

International Search Report, issued in PCT/JP2017/048765, dated Feb. 20, 2018.

(Continued)

*Primary Examiner* — Manish S Shah

(74) *Attorney, Agent, or Firm* — Birch, Stewart, Kolasch & Birch, LLP

(57) ABSTRACT

The present invention relates to a cleaning liquid for a water-based ink that contains a pigment and a water-insoluble polymer, said cleaning liquid containing (A) a surfactant, (B) a water-soluble organic solvent containing (b-1) diethylene glycol monoisopropyl ether, and water, in which the surfactant (A) contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms, and a content of the water-soluble organic solvent (B) in the cleaning liquid is from 5 to 30% by mass; and a method of cleaning a water-based ink using the cleaning liquid.

18 Claims, No Drawings

(56) References Cited

OTHER PUBLICATIONS

Extended European Search Report, dated Jul. 17, 2020, for European Application No. 17888161.1.

* cited by examiner

CLEANING LIQUID FOR AQUEOUS INK

FIELD OF THE INVENTION

The present invention relates to a cleaning liquid for a water-based ink.

BACKGROUND OF THE INVENTION

In ink-jet printing methods, droplets of ink are directly projected from very fine nozzles onto a printing medium using an ink-jet printer, and allowed to adhere to the printing medium to obtain printed materials on which characters or images are printed. In the sites actually using the ink-jet printer, if the nozzles of the ink-jet printer suffer from ejection defects, etc., an end face or an ink ejection port of the respective nozzles is wiped with a nonwoven fabric, etc., impregnated with a cleaning liquid to remove a surplus amount of the ink attached thereto. In addition, in the case of using different kinds of inks, it is necessary to clean up an ink path within the ink-jet printer using a cleaning liquid before or after changing the ink to be used from one to another. Furthermore, in the case where a print head of the ink-jet printer remains in a non-used condition for a long period of time, it is usual that after removing the ink from the print head, the cleaning liquid is filled in the print head, and the print head filled with the cleaning liquid is closed by capping for storage.

Also, in a gravure printing method, an ink is transferred to a printing medium using a gravure printing plate cylinder on which recessed cells for receiving) the ink are formed. The depth of each of the cells as well as the distance the respective cells (number of lines) fan be adequately determined to well control a quality of characters or images printed by the gravure printing method. In this case, if the gravure printing plate cylinder is stained or fouled by the ink, it is required that the cylinder is dismounted from the gravure printer and then cleaned with a brush, etc., while dissolving the ink deposited thereon using a cleaning liquid. In consequence, there have been conventionally proposed various cleaning liquids containing a surfactant.

For example, JP 9-31490A (Patent Literature 1) discloses an aqueous industrial degreasing detergent that is capable of satisfying required performance such as environmental characteristics, and contains a polyethylene glycol ether-type nonionic surfactant.

JP 2013-241552A (Patent Literature 2) discloses a cleaning and filling liquid for an ink-jet printing apparatus which is excellent in wettability and cleanability, etc., in which a surfactant used therein contains at least a fluorine-based surfactant and an acetylene glycol-based surfactant having an average molar number of addition of ethyleneoxide of 0 to 30.

SUMMARY OF THE INVENTION

The present invention relates to a cleaning liquid for a water-based ink that contains a pigment and a water-insoluble polymer, said cleaning liquid containing (A) a surfactant, (B) a water-soluble organic solvent containing (b-1) diethylene glycol monoisopropyl ether, and water, in which the surfactant (A) contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms, and a content of the water-soluble organic solvent (B) in the cleaning liquid is not less than 5% by mass and not more than 30% by mass.

DETAILED DESCRIPTION OF THE INVENTION

On the other hand, in an ink-jet printer or a gravure printer, a water-based ink containing a pigment and a water-insoluble polymer has been used in order to improve dispersibility of the pigment in the ink or improve fixing properties of the ink on the resulting printed material. When the pigment and the water-insoluble polymer contained in such a water-based ink are solidified, the bonding between the pigment and the polymer or between the polymer molecules is strengthened. For this reason, there is an increasing demand for a cleaning liquid having higher cleanability for the water-based ink containing the pigment and the water-insoluble polymer.

The present invention relates to a cleaning liquid for a water-based ink that is excellent in cleanability for the water-based ink that contains a pigment and a water-insoluble polymer, and a method of cleaning a water-based ink using the cleaning liquid.

The present inventors have found that by using a cleaning liquid that contains a specific surfactant, a water-soluble organic solvent containing diethylene glycol monoisopropyl ether, and water, it is possible to improve cleanability for a water-based ink that contains a pigment and a water-insoluble polymer.

That is, the present invention relates to the following aspects [1] and [2].

[1] A cleaning liquid for a water-based ink that contains a pigment and a water-insoluble polymer, said cleaning liquid containing (A) a surfactant, (B) a water-soluble organic solvent containing (b-1) diethylene glycol monoisopropyl ether, and water, in which the surfactant (A) contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms, and a content of the water-soluble organic solvent (B) in the cleaning liquid is not less than by mass and not more than 3.0% by mass.

[2] A method of cleaning a water-based ink, including the step of allowing the water-based ink that contains a pigment and a water-insoluble polymer to come into contact with the cleaning liquid according to the above aspect [1].

In accordance with the present invention, it is possible to provide a cleaning liquid for a water-based ink which is excellent in cleanability for the water-based ink that contains a pigment and a water-insoluble polymer, and a method of cleaning a water-based ink using the cleaning liquid.

[Cleaning Liquid for Water-Based Ink]

The cleaning liquid for a water-based ink according to the present invention (hereinafter also referred to merely as a "cleaning liquid") is used for cleaning the water-based ink that contains a pigment and a water-insoluble polymer (hereinafter also referred to merely as a "polymer"). The cleaning liquid contains (A) a surfactant, (B) a water-soluble organic solvent containing (b-1) diethylene glycol monoisopropyl ether, and water, in which the surfactant (A) contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms, and a content of the water-soluble organic solvent (B) in the cleaning liquid is not less than 5% by mass and not more than 30% by mass.

Meanwhile, the term "water-based" as used herein means that water has a largest content among components of a dispersing medium contained in the ink, and the "water-based ink" is hereinafter also referred to merely as an "ink".

Furthermore, the acetylene glycol as used in the present invention means a so-called acetylene glycol-based surfactant in a broad sense, more specifically, a nonionic surfactant having such a structure in which an acetylene group is located at a center thereof, and not only a hydroxy group but also a hydrocarbon group may be bonded thereto. The number of carbon atoms in the hydrocarbon group is preferably not less than 1 and not more than 6.

The cleaning liquid of the present invention is excellent in cleanability for an ink that contains a pigment and a water-insoluble polymer. The reason why the aforementioned advantageous effect can be attained by the present invention is considered as follows though it is not clearly determined.

That is, diethylene glycol monoisopropyl ether contained as the water-soluble organic solvent in the cleaning liquid has good balance between hydrophilic and hydrophobic properties, and is therefore capable of more effectively exhibiting a function as the surfactant. As a result, it is considered that penetrability of the surfactant into the polymer, in particular, penetrability of the surfactant between a member to be cleaned and the polymer is accelerated, so that the surfactant and the diethylene glycol monoisopropyl ether are cooperated with each other to weaken the bonding between the pigment and the polymer or the bonding between the polymer molecules and thereby improve cleanability for the ink that contains the pigment and the water-insoluble polymer.

<Surfactant (A)>

The surfactant (A) (hereinafter also referred to merely as a "component (A)") contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms. By incorporating such a surfactant in the cleaning liquid, it is possible to improve penetrability of the surfactant into the polymer and improve cleanability for ink.

The acetylene glycol or the ethyleneoxide adduct of the acetylene glycol (a-1) (hereinafter also referred to merely as a "component (a-1)") is preferably at least one compound selected from the group consisting of 2,4,7,9-tetramethyl-5-decyne-4,7-diol or an ethyleneoxide adduct (hereinafter also referred to merely as an "EO adduct") thereof, 3,6-dimethyl-4-octyne-3,6-diol or an EO adduct thereof, 2,5-dimethyl-3-hexyne-2,5-diol or an EO adduct thereof, 2,5,8,11-tetramethyl-6-dodecyne-5,8-diol or an EO adduct thereof, and 3,5-dimethyl-1-hexyne-3-ol or an EO adduct thereof, more preferably at least one compound selected from the group consisting of 2,4,7,9-tetramethyl-5-decyne-4,7-diol or an EO adduct thereof, 3,6-dimethyl-4-octyne-3,6-diol or an EO adduct thereof, and 2,5-dimethyl-3-hexyne-2,5-diol and an EO adduct thereof, and even more preferably 2,4,7,9-tetramethyl-5-decyne-4,7-diol or an EO adduct thereof.

The average molar number of addition of ethyleneoxide (hereinafter also referred to merely as an "average molar number of addition of EO") of the component (a-1) is preferably not less than 0 mol, and is also preferably not more than 35 mol, more preferably not more than 30 mol, even more preferably not more than 25 mol, further even more preferably not more than 20 mol, still further even more preferably not more than 15 mol, furthermore preferably not more than 10 mol, furthermore preferably not more than 5 mol, furthermore preferably not more than 3 mol, furthermore preferably not more than 2 mol, furthermore preferably not more than 1 mol and furthermore preferably 0 from the viewpoint of improving cleanability for ink.

2,4,7,9-Tetramethyl-5-decyne-4,7-diol, 3,6-dimethyl-4-octyne-3,6-diol and 2,5-dimethyl-3-hexyne-2,5-diol can be synthesized by reacting acetylene with a ketone or an aldehyde corresponding to the aimed acetylene glycol, and may be obtained, for example, by the method described in Takehiko Fujimoto, a fully revised edition "New Introduction to Surfactants" published by Sanyo Chemical Industries, Ltd., 1992, pp. 94-107, etc.

The EO adducts of the acetylene glycol may be produced by subjecting the acetylene glycol obtained by the aforementioned method to addition reaction with ethyleneoxide (EO) such that the molar number of addition of EO thereof is adjusted to a desired value.

Specific examples of commercially available products of 2,4,7,9-tetramethyl-5-decyne-4,7-diol include "SURFYNOL 104" (average molar number of addition of EO: 0 mol; active ingredient content: 100% by mass) and "SURFYNOL 104PG-50" (a 50% by mass propylene glycol diluted solution of 2,4,7,9-tetramethyl-5-decyne-4,7-diol; average molar number of addition of EO: 0 mol) both available from Air Products & Chemicals, Inc., etc.

Specific examples of commercially available products of the EO adducts of 2,4,7,9-tetramethyl-5-decyne-4,7-diol include "SURFYNOL 420" (average molar number of addition of EO: 1 mol; active ingredient content: 100% by mass), "SURFYNOL 465" (average molar number of addition of EO: 10 mol; active ingredient content: 100% by mass) and "SURFYNOL 485" (average molar number of addition of EO: 30 mol; active ingredient content: 100% by mass) all available from Air Products & Chemicals, Inc., and "ACETYLENOL E81" (average molar number of addition of EO: 8.1 mol), "ACETYLENOL E100" (average molar number of addition of EO: 10 mol) and "ACETYLENOL E200" (average molar number of addition of EO: 20 mol) all available from Kawaken Fine Chemicals Co., Ltd., etc.

These compounds as the component (a-1) may be used alone or in combination of any two more thereof.

The polyethylene glycol alkyl ether containing an alkyl group having not less than 8 carbon atoms (hereinafter also referred to merely as a "polyethylene glycol alkyl ether") or the polyethylene glycol aryl ether containing an aryl group having not less than 6 carbon atoms (hereinafter also referred to merely as a "polyethylene glycol aryl ether") (a-2) (hereinafter also referred to merely as a "component (a-2)") is represented by the following formula (1):

$$R^1O-(EO)_n-H \quad (1)$$

wherein $R^1$ is an alkyl group having not less than 8 carbon atoms or an aryl group having not less than 6 carbon atoms; EO is a group derived from ethyleneoxide; and n is an average molar number of addition of EO.

The number of carbon atoms in the alkyl group represented by $R^1$ is not less than 8 and preferably not less than 10 from the viewpoint of improving cleanability for ink, and is also preferably not more than 18, more preferably not more than 16, even more preferably not more than 14, further even more preferably not more than 12 and still further even more preferably 12 from the same viewpoint as described above.

The alkyl group represented by $R^1$ may be in the form of either a straight chain or a branched chain. From the viewpoint of improving cleanability for ink, the alkyl group represented by $R^1$ is preferably a linear alkyl group, more preferably an octyl group, a decyl group, a dodecyl group, a tetradecyl group, a hexadecyl group or an octadecyl group, even more preferably an octyl group, a decyl group, a dodecyl group, a tetradecyl group or a hexadecyl group, further even more preferably a decyl group, a dodecyl group or a tetradecyl group, and still further even more preferably a dodecyl group.

The number of carbon atoms in the aryl group represented by $R^1$ is not less than 6 and preferably not less than 10 from the viewpoint of improving cleanability for ink, and is also preferably not more than 30 and more preferably not more than 25 from the same viewpoint as described above.

From the viewpoint of improving cleanability for ink, the aryl group represented by $R^1$ is a phenyl group, an alkyl phenyl group, a (poly)styrenated phenyl group, a (poly) benzyl phenyl group, a tolyl group, a xylyl group or the like. Among these aryl groups, preferred is a (poly)styrenated phenyl group, and more preferred is a distyrenated phenyl group.

The average molar number n of addition of EO in the aforementioned formula (1) is preferably not less than 4, more preferably not less than 8 and even more preferably not less than 10 from the viewpoint of enhancing hydrophilicity of the surfactant and improving cleanability for ink, and is also preferably not more than 30, more preferably not more than 25, even more preferably not more than 20 and further even more preferably not more than 15 from the viewpoint of improving cleanability for ink.

Specific examples of the polyethylene glycol alkyl ether include polyethylene glycol mono-2-ethylhexyl ether, polyethylene glycol monooctyl ether polyethylene glycol monodecyl ether, polyethyleneglycol ether and polyethylene glycol monotetradecyl ether. Among these polyethylene glycol alkyl ethers, from the viewpoint of improving cleanability for ink, preferred is at least one compound selected from the group consisting of polyethylene glycol monodecyl ether and polyethylene glycol monododecyl ether, and more preferred is polyethylene glycol monododecyl ether.

Examples of commercially available products of the polyethylene glycol alkyl ether include "NOIGEN" available from DKS Co., Ltd., "EMULGEN" available from Kao Corporation, etc.

Specific examples of the polyethylene glycol aryl ether include polyethylene glycol octyl phenyl ether, polyethylene glycol nonyl phenyl ether, polyethylene glycol distyrenated phenyl ether and polyethylene glycol tribenzyl phenyl ether. Among these polyethylene glycol aryl ethers, preferred is polyethylene glycol distyrenated phenyl ether. Examples of commercially available products of the polyethylene glycol aryl ether include "EMULGEN A-60", "EMULGEN A-90", "EMULGEN A-500" and "EMULGEN B-66" all available from Kao Corporation, etc.

These compounds as the component (a-2) may be used alone or in combination of any two or more thereof.

The surfactant (A) may also contain a surfactant other than the components (a-1) and (a-2). Examples of the surfactant other than the components (a-1) and (a-2) include alcohol-based compounds, silicone-based compounds, etc.

From the viewpoint of improving cleanability for ink, the component (a-1) and the component (a-2) are preferably used in combination with each other. As the combination of the component (a-1) and the component (a-2), preferred is a combination of the acetylene glycol with at least one compound selected from the group consisting of the polyethylene glycol alkyl ether and the polyethylene glycol aryl ether.

<Water-Soluble Organic Solvent (B)>

The water-soluble organic solvent (B) used in the present invention (hereinafter also referred to merely as a "component (B)") contains diethylene glycol monoisopropyl ether (b-1). The diethylene glycol monoisopropyl ether (b-1) has good balance between hydrophilicity and hydrophobicity, and is therefore capable of allowing the surfactant to more effectively exhibit its effects. As a result, penetrability of the surfactant into the polymer, in particular, penetrability of the surfactant between the member to be cleaned and the polymer, is accelerated, so that the resulting cleaning liquid can be improved in cleanability for an ink that contains a pigment and a water-insoluble polymer.

Meanwhile, the "water-soluble organic solvent" as used in the present invention means an organic solvent having a solubility in water of not less than 10 mL as measured by dissolving the organic solvent in 100 mL of water at 25° C.

The boiling point of the water-soluble organic solvent (B) is preferably not lower than 150° C., more preferably not lower than 170° C. and even more preferably not lower than 190° C. from the viewpoint of preventing the cleaning liquid from being dried, and is also preferably not higher than 260° C., more preferably not higher than 250° C., even more preferably not higher than 230° C. and further even more preferably not higher than 210° C. from the viewpoint of obtaining a cleaning liquid that hardly remains on a member to be cleaned.

The water-soluble organic solvent (B) may further contain, in addition to the component (b-1), a water-soluble organic solvent other than the component (b-1). In the case where the water-soluble organic solvent other than the component (b-1) is contained as the water-soluble organic solvent (B), the boiling point of the water-soluble organic solvent (B) is calculated in terms of a weighted mean value thereof. As the boiling point of the organic solvent is lowered, the saturated vapor pressure of the organic solvent as measured at a specific temperature is increased, so that the evaporation rate of the organic solvent as measured at the specific temperature is also increased. In addition, as the content of the organic solvent having a high evaporation rate as measured at a specific temperature in a mixed organic solvent is increased, the evaporation rate of the mixed organic solvent as measured at the specific temperature is also increased. For this reason, the weighted mean value thus calculated serves as an index of the evaporation rate of the mixed organic solvent.

The water-soluble organic solvent (B) preferably further contains various other water-soluble organic solvents. Examples of the other water-soluble organic solvents include a polyhydric alcohol other than the component (a-1) (hereinafter also referred to merely as a "polyhydric alcohol"), a polyhydric alcohol alkyl ether other than the component (a-2) and the component (b-1) (hereinafter also referred to merely as a "polyhydric alcohol alkyl ether"), a nitrogen-containing heterocyclic compound, an amide, an amine and a sulfur-containing compound.

Examples of the polyhydric alcohol include ethylene glycol (boiling point (b.p.) 197° C.), diethylene glycol (b.p. 244° C.), polyethylene glycol, propylene glycol (b.p. 188° C.), dipropylene glycol (b.p. 232° C.), polypropylene glycol, 1,3-propanediol (b.p. 210° C.), 1,3-butanediol (b.p. 208° C.), 1,4-butanediol (b.p. 230° C.), 3-methyl-1,3-butanediol (b.p. 203° C.), 1,5-pentanediol (b.p. 242° C.), 2-methyl-2,4-pentanediol (b.p. 196° C.), 1,2,6-hexanetriol (b.p. 178° C.), 1,2,4-butanetriol (b.p. 190° C.), 1,2,3-butanetriol (b.p. 175° C.) and petriol (b.p. 216° C.). In addition, 1,6-hexanediol (b.p. 250° C.), triethylene glycol (b.p. 285° C.), tripropylene glycol (b.p. 273° C.), glycerin (b.p. 290° C.) and the like may be used in combination with the compound whose boiling point is preferably lower than 260° C. and more preferably lower than 250° C.

Specific examples of the polyhydric alcohol alkyl ether include ethylene glycol monoethyl ether (b.p. 135° C.), ethylene glycol monobutyl ether (b.p. 171° C.), diethylene glycol monomethyl ether (b.p. 194° C.), diethylene glycol monoethyl ether (b.p. 202° C.), diethylene glycol monobutyl ether (b.p. 230° C.), triethylene glycol monomethyl ether (b.p. 122° C.), triethylene glycol monoisobutyl ether (b.p. 160° C.), tetraethylene glycol monomethyl ether (b.p. 158° C.), propylene glycol monoethyl ether (b.p. 133° C.), dipropylene glycol monomethyl ether (b.p. 90° C.), dipropylene glycol monobutyl ether (b.p. 227° C.), tripropylene glycol monomethyl ether (b.p. 100° C.) and tripropylene glycol monobutyl ether. In addition, triethylene glycol monobutyl ether (b.p. 276° C.) and the like may be used in combination with the compound whose boiling point is lower than 250° C.

Meanwhile, the polyhydric alcohol may be used in the form of a mixed alcohol containing a plurality of compounds belonging to the concept of the polyhydric alcohol, and the polyhydric alcohol alkyl ether may also be used in the form of a mixed ether containing a plurality of compounds belonging to the concept of the polyhydric alcohol alkyl ether.

Examples of the nitrogen-containing heterocyclic compound include N-methyl-2-pyrrolidone (b.p. 202° C.), 2-pyrrolidone (b.p. 245° C.), 1,3-dimethyl imidazolidinone (b.p. 220° C.) and ε-caprolactam (b.p. 136° C.).

Examples of the amide include formamide (b.p. 210° C.), N-methylformamide (b.p. 199° C.) and N,N-dimethylformamide (b.p. 153° C.).

Examples of the amine include monoethanolamine (b.p. 170° C.), diethanolamine (b.p. 217° C.), triethanolamine (b.p. 208° C.) and triethylamine (b.p. 90° C.).

Examples of the sulfur-containing compound include dimethyl sulfoxide (b.p. 189° C.) and the like. In addition, sulfolane (b.p. 285° C.) and thiodiglycol (b.p. 282° C.), etc., may be used in combination with the compound whose boiling point is lower than 250° C.

The water-soluble organic solvent (B) preferably still further contains (b-2) a compound having a solubility parameter (hereinafter also referred to merely as an "SP value") of not less than 20 $(MPa)^{1/2}$ and not more than 35 $(MPa)^{1/2}$ (hereinafter also referred to merely as a "compound (b-2)" or a "component (b-2)") as a water-soluble organic solvent other than the component (b-1). By incorporating the component (b-2) into the cleaning liquid, it is possible to enhance affinity of the resulting cleaning liquid to the polymer and thereby improve cleanability of the cleaning liquid for ink.

The content of the compound (b-2) in the cleaning liquid is preferably not less than 1% by mass and more preferably not less than 3% by mass, and is also preferably not more than 15% by mass and more preferably not more than 12% by mass, from the viewpoint of improving cleanability for ink.

The solubility parameter used in the present invention is a Hansen SP value. The Hansen SP value as used herein may be calculated from three kinds of energy parameters obtained by dividing an interaction energy acting between molecules of substances on the basis of chemical structures thereof. More specifically, the Hansen SP value is calculated according to the following equation:

$$\delta=(\delta_d^2+\delta_p^2+\delta_h^2)^{1/2}$$

wherein $\delta_d$ is a London dispersion force item, $\delta_p$ is a dipolar intermolecular force item, and $\delta_h$ is a hydrogen bonding item. The details of $\delta_d$, $\delta_p$ and $\delta_h$ of the respective water-soluble organic solvents are described more specifically in "HANSEN SOLUBILITY PARAMETERS", A User' Handbook, Second Edition.

In addition, if the SP value is not determined by the aforementioned method, there may also be used the value described in "Solubility Parameter Values" VII, pp. 675-714 of "Polymer Handbook, Fourth Edition", published in 1999 by John Wiley & Sons, Inc., etc.

The SP value of the compound (b-2) is preferably not less than 20 $(MPa)^{1/2}$, more preferably not less than 21 $(MPa)^{1/2}$, even more preferably not less than 23 $(MPa)^{1/2}$, further even more preferably not less than 25 $(MPa)^{1/2}$ and still further even more preferably not less than 27 $(MPa)^{1/2}$, and is also preferably not more than 35 $(MPa)^{1/2}$, more preferably not more than 33 $(MPa)^{1/2}$ and even more preferably not more than 30 $(MPa)^{1/2}$, from the viewpoint of improving cleanability for ink.

As the compound (b-2), preferred are a polyhydric alcohol and a polyhydric alcohol alkyl ether, and more preferred is a polyhydric alcohol. Specific examples of the compound (b-2) include diethylene glycol (SP value: 28 $(MPa)^{1/2}$), propylene glycol (SP value: 29 $(MPa)^{1/2}$), 1,3-butanediol (SP value: 28 $(MPa)^{1/2}$), diethylene glycol monoethyl ether (SP value: 22 $(MPa)^{1/2}$), diethylene glycol monobutyl ether (SP value: 20 $(MPa)^{1/2}$) and glycerin (SP value: 34 $(MPa)^{1/2}$). Among these compounds (b-2), even more preferred are propylene glycol and glycerin.

(Other Components)

In the cleaning liquid of the present invention, in addition to the aforementioned components, various additives that are usually used in cleaning liquids for ink, such as a pH modifier, a defoaming agent, an antiseptic agent, a mildew-proof agent and a rust preventive may also be added thereto.

Incidentally, the cleaning liquid of the present invention contains neither a pigment nor a polymer.

(Process for Producing Cleaning Liquid)

The cleaning liquid of the present invention may be produced by mixing the component (A), the compound (B) and water, if required together with the aforementioned various additives, followed by stirring the resulting mixture.

The contents of the respective components in the cleaning liquid of the present invention as well as properties of the cleaning liquid are as follows.

The content of the component (A) in the cleaning liquid is preferably not less than 0.3% by mass, more preferably not less than 0.5% by mass and even more preferably not less than 0.7% by mass from the viewpoint of improving cleanability for ink, and is also preferably not more than 10% by mass, more preferably not more than 5% by mass, even more preferably not more than 3% by mass and further even more preferably not more than 1.5% by mass from the same viewpoint as described above.

The content of the component (a-1) in the cleaning liquid is preferably not less than 0.01% by mass, more preferably not less than 0.05% by mass, even more preferably not less than 0.1% by mass and further even more preferably not less than 0.3% by mass from the viewpoint of improving cleanability for ink, and is also preferably not more than 5% by mass, more preferably not more than 3% by mass, even more preferably not more than 1% by mass and further even more preferably not more than 0.7% by mass from the same viewpoint as described above.

The content of the component (a-2) in the cleaning liquid is preferably not less than 0.01% by mass, more preferably not less than 0.05% by mass, even more preferably not less than 0.1% by mass and further even more preferably not less than 0.3% by mass from the viewpoint of improving cleanability for ink, and is also preferably not more than 5% by mass, more preferably not more than 3% by mass, even more preferably not more than 1% by mass and further even more preferably not more than 0.7% by mass from the same viewpoint as described above.

In the case where the component (a-1) is used in combination with the component (a-2), the mass ratio of the component (a-1) to the component (a-2) [(a-1)/(a-2)] is preferably not less than 0.1, more preferably not less than 0.5 and even more preferably not less than 0.7 from the viewpoint of improving cleanability for ink, and is also preferably not more than 2, more preferably not more than 1.5 and even more preferably not more than 1.3 from the same viewpoint as described above.

The total content of the component (a-1) and the component (a-2) in the surfactant (A) is preferably not less than 80% by mass, more preferably not less than 90% by mass, even more preferably not less than 95% by mass, further even more preferably substantially 100% by mass and still further even more preferably 100% by mass.

The content of the component (B) in the cleaning liquid is preferably not less than 5% by mass, more preferably not less than 7% by mass and even more preferably not less than 10% by mass from the viewpoint of improving cleanability for ink, and is also preferably not more than 30% by mass, more preferably not more than 27% by mass, even more preferably not more than 23% by mass and further even more preferably not more than 17% by mass from the viewpoint of reducing burden on the environment.

The content of the component (b-1) in the cleaning liquid is preferably not less than 3% by mass and more preferably not less than 5% by mass, and is also preferably not more than 25% by mass, more preferably not more than 20% by mass, even more preferably not more than 15% by mass and further even more preferably not more than 10% by mass.

The mass ratio of the component (A) to the component (b-1) [(A)/b-1)] is preferably not less than 0.01, more preferably not less than 0.03 and even more preferably not less than 0.07, and is also preferably not more than 2, more preferably not more than 1, even more preferably not more than 0.5, further even more preferably not more than 0.3, still further even more preferably not more than 0.2 and furthermore preferably not more than 0.1.

The mass ratio of the component (b-2) to the component (b-1) [(b-2)/(b-1)] is preferably not less than 0.03, more preferably not less than 0.05, even more preferably not less than 0.1, further even more preferably not less than 0.2, still further even more preferably not less than 0.3 and furthermore preferably not less than 0.4, and is also preferably not more than 3, more preferably not more than 2, even more preferably not more than 1 and further even more preferably not more than 0.7.

The total content of the component (b-1) and the component (b-2) in the water-soluble organic solvent (B) is preferably not less than 80% by mass, more preferably not less than 90% by mass, even more preferably not less than 95% by mass, further even more preferably substantially 100% by mass and still further even more preferably 100% by mass.

The content of water in the cleaning liquid is preferably not less than 60% by mass, more preferably not less than 70% by mass and even more preferably not less than 80% by mass from the viewpoint of enhancing productivity of the cleaning liquid, and is also preferably not more than 98% by mass, more preferably not more than 95% by mass, even more preferably not more than 90% by mass and further even more preferably not more than 85% by mass from the viewpoint of improving cleanability for ink.

(Properties of Cleaning Liquid)

The viscosity of the cleaning liquid as measured at 25° C. is preferably not less than 0.9 mPa·s, more preferably not less than 1.0 mPa·s and even more preferably not less than 1.05 mPa·s from the viewpoint of improving cleanability for ink, and is also preferably not more than 5 mPa·s, more preferably not more than 4 mPa·s and even more preferably not more than 3 mPa·s from the viewpoint of improving cleanability for ink as well as from the viewpoint of obtaining a cleaning liquid that hardly remains on a member to be cleaned.

Meanwhile, the viscosity at 25° C. of the cleaning liquid may be measured by the method described in Examples below.

The pH value of the cleaning liquid is preferably not less than 7.0, more preferably not less than 8.0 and even more preferably not less than 8.5, and is also preferably not more than 11.0 and more preferably not more than 10.0 from the viewpoint of improving resistance of a member to be cleaned to the cleaning liquid as well as from the viewpoint of suppressing skin irritation by the cleaning liquid.

Meanwhile, the pH value of the cleaning liquid may be measured by the method described in Examples below.

The cleaning liquid of the present invention is excellent in cleanability for ink. Therefore, the cleaning liquid of the present invention may be suitably used as a cleaning liquid for cleaning a water-based ink that contains a pigment and a water-insoluble polymer, more specifically, may also be used as a cleaning liquid for a water-based ink for flexographic printing, a water-based ink for gravure printing or a water-based ink for ink-jet printing. In particular, the cleaning liquid of the present invention is preferably used as a cleaning liquid for a water-based ink for gravure printing or a water-based ink for ink-jet printing.

<Water-Based Ink>

The water-based ink contains a pigment and a water-insoluble polymer.

(Pigment)

The pigment contained in the water-based ink may be either an inorganic pigment or an organic pigment. The inorganic or organic pigment may also be used in combination with an extender pigment, if required.

Specific examples of the inorganic pigment include carbon blacks, metal oxides and the like. Of these inorganic pigments, in particular, carbon blacks are preferably used for black inks. The carbon blacks may include furnace blacks, thermal lamp blacks, acetylene blacks and channel blacks.

Specific examples of the organic pigment include azo pigments, diazo pigments, phthalocyanine pigments, quinacridone pigments, isoindolinone pigments, dioxazine pigments, perylene pigments, perinone pigments, thioindigo pigments, anthraquinone pigments and quinophthalone pigments.

The hue of the organic pigment used in the present invention is not particularly limited, and there may be used any chromatic pigment having a yellow color, a magenta color, a cyan color, a blue color, a red color, an orange color, a green color, etc.

Specific examples of the preferred organic pigments include one or more pigments selected from the group consisting of commercially available products marketed under the names of C.I. Pigment Yellow, C.I. Pigment Red, C.I. Pigment Orange, C.I. Pigment Violet, C.I. Pigment Blue and C.I. Pigment Green with various part numbers.

Examples of the extender pigment include silica, calcium carbonate and talc.

The pigment may be contained in the water-based ink in the form of a self-dispersible pigment, a pigment dispersed in the water-based ink with a dispersant, or pigment-containing water-insoluble polymer particles (hereinafter also referred to merely as "pigment-containing polymer particles").

(Water-Insoluble Polymer)

The water-insoluble polymer contained in the water-based ink has at least any one of a function as a pigment dispersant capable of exhibiting the effect of dispersing the pigment in the water-based ink, and a function as a fixing agent for fixing the water-based ink on a printing medium.

The term "water-insoluble" as used herein means that when a polymer is dried to a constant weight at 105° C. for 2 hours and then dissolved in 100 g of water at 25° C., the solubility in water of the polymer is not more than 10 g. The solubility in water of the water-insoluble polymer is preferably not more than 5 g and more preferably not more than 1 g. In the case where the water-insoluble polymer is in the form of an anionic polymer, the solubility means a solubility in water of the water-insoluble polymer whose anionic groups are neutralized completely (i.e., 100%) with sodium hydroxide. On the other hand, in the case where the water-insoluble polymer is in the form of a cationic polymer, the solubility means a solubility in water of the water-insoluble polymer whose cationic groups are neutralized completely (i.e., 100%) with hydrochloric acid.

Examples of the water-insoluble polymer having a function as a pigment dispersant include polyesters, polyurethanes and vinyl-based polymers. Among these water-insoluble polymers, from the viewpoint of improving ejection stability of the water-based ink, preferred are vinyl-based polymers obtained by addition-polymerizing a vinyl monomer (such as vinyl compounds, vinylidene compounds and vinylene compounds), more preferred is at least one polymer selected from the group consisting of an acrylic polymer and a styrene-acrylic polymer, and even more preferred is a styrene-acrylic polymer.

In the case where the water-insoluble polymer is in the form of a vinyl-based polymer, the vinyl-based polymer preferably contains one or more constitutional units selected from the group consisting of a constitutional unit derived from an ionic monomer, a constitutional unit derived from a hydrophobic monomer and a constitutional unit derived from a hydrophilic nonionic monomer, and more preferably two or more constitutional units selected from the group consisting of the aforementioned constitutional units. Examples of a combination of the monomers from which the two or more constitutional units are derived include a combination of the ionic monomer and the hydrophobic monomer and a combination of the ionic monomer, the hydrophobic monomer and the hydrophilic nonionic monomer.

The vinyl-based polymer used in the present invention may be produced, for example, by subjecting a monomer mixture containing the ionic monomer, the hydrophobic monomer and the hydrophilic nonionic monomer to addition polymerization by conventionally known methods.

Examples of the ionic monomer include anionic monomers such as carboxylic acid monomers, sulfonic acid monomers and phosphoric acid monomers; and cationic monomers such as N,N-dimethylaminoethyl methacrylate and N,N-dimethylaminoethyl acrylamide. Among these ionic monomers, preferred are anionic monomers, more preferred are carboxylic acid monomers, and even more preferred is (meth)acrylic acid. Meanwhile, the ionic monomer may also include those monomers that have no ionicity under neutral conditions, such as acids and amines, but are converted into ions under acid or alkaline conditions.

Examples of the hydrophobic monomer include an alkyl (meth)acrylate having not less than 1 and not more than 22 carbon atoms, a styrene-based monomer, an aromatic group-containing (meth)acrylate and a styrene-based macromonomer. The styrene-based macromonomer is a compound containing a polymerizable functional group at one terminal end thereof and having a number-average molecular weight of not less than 500 and not more than 100,000.

Examples of the hydrophilic nonionic monomer include polyalkylene glycol mono(meth)acrylates such as polyethylene glycol mono(meth)acrylate; and alkoxy polyalkylene glycol mono(meth)acrylates such as methoxy polyethylene glycol mono(meth)acrylate and octoxy polyethylene glycol mono(meth)acrylate.

Meanwhile, the term "(meth)acrylic acid" as used herein means at least one compound selected from the group consisting of acrylic acid and methacrylic acid. Also, the term "(meth)acrylate" as used herein means at least one compound selected from the group consisting of an acrylate and a methacrylate.

The styrene-acrylic polymer is preferably in the form of an acrylic-styrene-based polymer containing a constitutional unit derived from (meth)acrylic acid, a constitutional unit derived from a styrene-based monomer, a constitutional unit derived from a styrene-based macromonomer and a constitutional unit derived from an alkoxy polyalkylene glycol mono(meth)acrylate.

The water-based ink preferably contains pigment-containing water-insoluble polymer particles produced by using the aforementioned vinyl-based polymer as the water-insoluble polymer (hereinafter also referred to merely as "pigment-containing polymer particles") from the viewpoint of improving dispersion stability and ejection stability of the water-based ink. The pigment-containing polymer particles have any configuration as long as the particles are formed of the pigment and the water-insoluble polymer. In the ink, the water-insoluble polymer is adsorbed onto the pigment to form the pigment-containing polymer particles. Examples of the configuration of the pigment-containing polymer particles in the ink include the particle configuration in which the pigment is enclosed (encapsulated) in the water-insoluble polymer, the particle configuration in which the pigment is uniformly dispersed in the water-insoluble polymer, the particle configuration in which the pigment is exposed to the surface of the respective polymer particles, and the mixed configuration of these configurations.

The pigment-containing polymer particles may be obtained by subjecting the pigment and the water-insoluble polymer, if required together with a neutralizing agent, a surfactant, etc., to dispersion treatment by conventionally known methods.

Examples of the water-insoluble polymer having a function as a fixing agent for fixing the ink on a printing medium include an acrylic polymer, a vinyl acetate-based polymer, a styrene-butadiene-based polymer, a vinyl chloride-based polymer, a styrene-(meth)acrylic polymer, a urethane-based polymer, a butadiene-based polymer and a styrene-based polymer. These water-insoluble polymers may be used alone or in combination of any two or more thereof. Among these water-insoluble polymers, more preferred is at least one polymer selected from the group consisting of an acrylic polymer and a styrene-acrylic polymer, and more preferred is an acrylic polymer.

From the viewpoint of improving fixing properties of the water-based ink on a printing medium and rub fastness of the printed characters or images, the water-insoluble polymer having a function as a fixing agent for fixing the ink on a printing medium is preferably used in the form of pigment-free water-insoluble polymer particles, more preferably in the form of water-insoluble polymer particles obtained by emulsion polymerization, even more preferably in the form of particles that are constituted of a polymer obtained by subjecting an ethylenically unsaturated monomer to emulsion polymerization, further even more preferably in the form of particles that are constituted of an acrylic polymer, and still further even more preferably in the form of particles that are constituted of an acrylic polymer containing a constitutional unit derived from (meth)acrylic acid and a constitutional unit derived from a (meth)acrylate.

The pigment-free water-insoluble polymer particles are preferably used in the form of a dispersion thereof from the viewpoint of improving handling properties thereof, and may be either a synthesized product obtained by emulsion polymerization, etc., or a commercially available product. Examples of commercially available products of the dispersion of the pigment-free water-insoluble polymer particles include dispersions of acrylic polymers such as "Neocryl A1127" (anionic self-crosslinkable aqueous acrylic polymer) available from DSM NeoResins, Inc., and "JONCRYL 390" available from BASF Japan, Ltd.; urethane-based polymers such as "WBR-2018" and "WBR-2000U" both available from Taisei Fine Chemical Co., Ltd.; styrene-butadiene polymers such as "SR-100" and "SR102" both available from Nippon A & L Inc.; styrene-acrylic polymers such as "JONCRYL 7100", "JONCRYL 734" and "JONCRYL 538" all available from BASF Japan, Ltd.; and vinyl chloride-based polymers such as "VINYBLAN 701" available from Nissin Chemical Co., Ltd., etc.

The water-insoluble polymer contained in the water-based ink is preferably in the form of pigment-containing polymer particles or pigment-free polymer particles. The water-based ink more preferably contains the pigment-containing polymer particles and the pigment-free water-insoluble polymer particles.

The cleaning liquid of the present invention is excellent in cleanability for ink and dissolvability of a surfactant therein. Therefore, the cleaning liquid of the present invention is able to more remarkably exhibit its effects when used for cleaning a water-based ink containing the pigment-containing polymer particles or the pigment-free polymer particles.

In the case where the water-based ink contains the pigment-containing polymer particles, the weight-average molecular weight of the water-insoluble polymer constituting the pigment-containing polymer particles is preferably not less than 5,000, more preferably not less than 10,000 and even more preferably not less than 20,000, and is also preferably not more than 500,000, more preferably not more than 400,000, even more preferably not more than 300,000, further even more preferably not more than 200,000 and still further even more preferably not more than 100,000.

In the case where the water-based ink contains the pigment-free water-insoluble polymer particles, the weight-average molecular weight of the water-insoluble polymer constituting the pigment-free water-insoluble polymer particles is preferably not less than 100,000, more preferably not less than 200,000, even more preferably not less than 300,000 and further even more preferably not less than 500,000, and is also preferably not more than 2,000,000, more preferably not more than 1,500,000, even more preferably not more than 1,000,000 and further even more preferably not more than 800,000.

The water-based ink may further contain an organic solvent as a component other than the pigment, the water-insoluble polymer and water, if required. In addition, the water-based ink may also contain, as optional components, various additives such as a humectant, a wetting agent, a penetrant, a dispersant, a surfactant, a viscosity controller, a defoaming agent, an antiseptic agent, a mildew-proof agent and a rust preventive.

(Method for Producing Water-Based Ink)

The water-based ink may be produced by mixing the pigment, the water-insoluble polymer and water, if required together with a neutralizing agent, a surfactant, an organic solvent, etc., and then stirring the resulting mixture.

The contents of the respective components in the water-based ink are as follows. In the case where the water-based ink contains the pigment-containing polymer particles, after previously subjecting the pigment and the water-insoluble polymer to dispersion treatment to obtain a dispersion of the pigment-containing polymer particles, the resulting dispersion may be compounded in the water-based ink.

(Content of Pigment)

The content of the pigment in the water-based ink is preferably not less than 1% by mass, more preferably not less than 2% by mass and even more preferably not less than 3% by mass from the viewpoint of enhancing optical density of the resulting printed characters or images, and is also preferably not more than 15% by mass, more preferably not more than 10% by mass, even more preferably not more than 8% by mass and further even more preferably not more than 6% by mass from the viewpoint of improving viscosity of the ink and rub fastness of the resulting printed characters or images.

(Content of Water-Insoluble Polymer)

The content of the water-insoluble polymer in the water-based ink is preferably not less than 0.5% by mass, more preferably not less than 1% by mass, even more preferably not less than 2% by mass and further even more preferably not less than 3% by mass from the viewpoint of improving fixing properties of the ink on a printing medium and rub fastness of the resulting printed characters or images, and is also preferably not more than 10% by mass, more preferably not more than 8% by mass and even more preferably not more than 6% by mass from the viewpoint of improving viscosity of the ink.

Meanwhile, in the case where the water-based ink contains both the pigment-containing polymer particles and the pigment-free polymer particles, the content of the water-insoluble polymer in the water-based ink means a total content of the water-insoluble polymer contained in the pigment-containing polymer particles and the water-insoluble polymer contained in the pigment-free polymer particles.

(Content of Water)

The content of water in the water-based ink is preferably not less than 30% by mass, more preferably not less than 40% by mass and even more preferably not less than 50% by mass from the viewpoint of improving rub fastness of the resulting printed characters or images and ejection stability of the ink, and is also preferably not more than 80% by mass, more preferably not more than 75% by mass and even more preferably not more than 70% by mass from the viewpoint of improving ejection stability of the ink.

[Method of Cleaning Water-Based Ink]

The method of cleaning the water-based ink according to the present invention includes the step of allowing the water-based ink that contains the pigment and the water-insoluble polymer to come into contact with the aforementioned cleaning liquid. As the contacting method between the water-based ink and the cleaning liquid, there may be used a coating method, a spraying method and a dipping method, etc. The water-based ink is preferably used for gravure printing or for ink-jet printing, and more preferably used for ink-jet printing, from the viewpoint of allowing the cleaning liquid to more effectively exhibit its cleaning effects.

Examples of the method of cleaning the water-based ink include a method in which the aforementioned cleaning liquid is impregnated into a wiping member such as a nonwoven fabric, and a surplus amount of the ink deposited on an end face or an ink ejection port of respective nozzles is wiped off with the wiping member; a method in which in the case of using different kinds of inks, an ink path within an ink-jet printer is cleaned with the cleaning liquid before or after changing the ink to be used from one to another, by repeating supply of the cleaning liquid accommodated in a cartridge into the ink path and discharge of the cleaning liquid from the ink path using a feed mechanism and a withdrawal mechanism of the ink-jet printer; and a method in which when allowing a print head to remain in an unused state for a long period of time, the ink is withdrawn from the print head, and the print head is filled with the cleaning liquid and closed by capping for storage. The wiping member used in the aforementioned cleaning method is not particularly limited as long as the member is capable of exhibiting good liquid absorbing properties. Examples of the wiping member include cloths such as a woven fabric, a knitted fabric and a nonwoven fabric, sponges and pulps.

With respect to the aforementioned embodiments, the present invention further provides the following aspects relating to the cleaning liquid for a water-based ink, and the cleaning method using the cleaning liquid.

<1> A cleaning liquid for a water-based ink that contains a pigment and a water-insoluble polymer, said cleaning liquid containing (A) a surfactant, (B) a water-soluble organic solvent containing (b-1) diethylene glycol monoisopropyl ether, and water, in which the surfactant (A) contains at least one compound selected from the group consisting of (a-1) an acetylene glycol or an ethyleneoxide adduct of the acetylene glycol, and (a-2) a polyethylene glycol alkyl ether containing an alkyl group having not less than 8 carbon atoms or a polyethylene glycol aryl ether containing an aryl group having not less than 6 carbon atoms, and a content of the water-soluble organic solvent (B) in the cleaning liquid is not less than 5% by mass and not more than 30% by mass.

<2> The cleaning liquid according to the above aspect <1>, wherein the acetylene glycol or the ethyleneoxide adduct of the acetylene glycol (a-1) is preferably at least one compound selected from the group consisting of 2,4,7,9-tetramethyl-5-decyne-4,7-diol or an EO adduct thereof, 3,6-dimethyl-4-octyne-3,6-diol or an EO adduct thereof, 2,5-dimethyl-3-hexyne-2,5-diol or an EO adduct thereof. 2,5,8,11-tetramethyl-6-dodecyne-5,8-diol or an EO adduct thereof, and 3,5-dimethyl-1-hexyne-3-ol or an EO adduct thereof, more preferably at least one compound selected from the group consisting of 2,4,7,9-tetramethyl-5-decyne-4,7-diol or an EO adduct thereof, 3,6-dimethyl-4-octyne-3,6-diol or an EO adduct thereof, and 2,5-dimethyl-3-hexyne-2,5-diol or an EO adducts thereof, and even more preferably 2,4,7,9-tetramethyl-5-decyne-4,7-diol or an EO adduct thereof.

<3> The cleaning liquid according to the above aspect <1> or <2>, wherein an average molar number of addition of EO of the acetylene glycol or the ethyleneoxide adduct of the acetylene glycol (a-1) is preferably not less than 0 mol, and is also preferably not more than 35 mol, more preferably not more than 30 mol, even more preferably not more than 25 mol, further even more preferably not more than 20 mol, still further even more preferably not more than 15 mol, furthermore preferably not more than 10 mol, furthermore preferably not more than 5 mol, furthermore preferably not more than 3 mol, furthermore preferably not more than 2 mol, furthermore preferably not more than 1 mol, and furthermore preferably 0.

<4> The cleaning liquid according to any one of the above aspects <1> to <3>, wherein the polyethylene glycol alkyl ether containing an alkyl group having not less than 8 carbon atoms or the polyethylene glycol aryl ether containing an aryl group having not less than 6 carbon atoms (a-2) is represented by the following formula (1);

$$R^1O-(EO)_n-H \quad (1)$$

wherein $R^1$ is an alkyl group having not less than 8 carbon atoms or an aryl group having not less than 6 carbon atoms: EO is a group derived from ethyleneoxide; and n is an average molar number of addition of EO.

<5> The cleaning liquid according to the above aspect <4>, wherein the number of carbon atoms in the alkyl group represented by $R^1$ is preferably not less than 10, and is also preferably not more than 18, more preferably not more than 16, even more preferably not more than 14, further even more preferably not more than 12 and still further even more preferably 12.

<6> The cleaning liquid according to the above aspect <4> or <5>, wherein the surfactant (A) is preferably a combination of the acetylene glycol or the ethyleneoxide adduct of the acetylene glycol (a-1) and the polyethylene glycol alkyl ether containing an alkyl group having not less than 8 carbon atoms or the polyethylene glycol aryl ether containing an aryl group having not less than 6 carbon atoms (a-2), and more preferably a combination of the acetylene glycol with at least one compound selected from the group consisting of the polyethylene glycol alkyl ether and the polyethylene glycol aryl ether.

<7> The cleaning liquid according to any one of the above aspects <1> to <6>, wherein a boiling point of the water-soluble organic solvent (B) is preferably not lower than 150° C., more preferably not lower than 170° C. and even more preferably not lower than 190° C., and is also preferably not higher than 260° C., more preferably not higher than 250° C., even more preferably not higher than 230° C. and further even more preferably not higher than 210° C.

<8> The cleaning liquid according to any one of the above aspects <1> to <7>, wherein the water-soluble organic solvent (B) further contains (b-2) a compound having a solubility parameter (SP value) of not less than 20 $(MPa)^{1/2}$ and not more than 35 $(MPa)^{1/2}$.

<9> The cleaning liquid according to the above aspect <8>, wherein a content of the compound (b-2) in the cleaning liquid is preferably not less than 1% by mass and more preferably not less than 3% by mass, and is also preferably not more than 15% by mass and more preferably not more than 12% by mass.

<10> The cleaning liquid according to the above aspect <8> or <9>, wherein the SP value of the compound (b-2) is preferably not less than 20 $(MPa)^{1/2}$, more preferably not less than 21 $(MPa)^{1/2}$, even more preferably not less than 23 $(MPa)^{1/2}$, further even more preferably not less than 25 $(MPa)^{1/2}$ and still further even more preferably not less than 27 $(MPa)^{1/2}$, and is also preferably not more than 35 $(MPa)^{1/2}$, more preferably not more than 33 $(MPa)^{1/2}$ and even more preferably not more than 30 $(MPa)^{1/2}$.

<11> The cleaning liquid according to any one of the above aspects <8> to <10>, wherein the compound (b-2) is preferably at least one compound selected from the group consisting of a polyhydric alcohol and a polyhydric alcohol alkyl ether, and preferably a polyhydric alcohol.

<12> The cleaning liquid according to any one of the above aspects <8> to <10>, wherein the compound (b-2) is preferably at least one compound selected from the group consisting of diethylene glycol, propylene glycol, 1,3-butanediol, diethylene glycol monoethyl ether, diethylene glycol monobutyl ether and glycerin, and more preferably at least one compound selected from the group consisting of propylene glycol and glycerin.

<13> The cleaning liquid according to any one of the above aspects <1> to <12>, wherein a content of the surfactant (A) in the cleaning liquid is preferably not less than 0.3% by mass, more preferably not less than 0.5% by mass and even more preferably not less than 0.7% by mass, and is also preferably not more than 10% by mass, more preferably not more than 5% by mass, even more preferably not more than 3% by mass and further even more preferably not more than 1.5% by mass.

<14> The cleaning liquid according to any one of the above aspects <1> to <13>, wherein a content of the acetylene glycol or the ethyleneoxide adduct of the acetylene glycol (a-1) in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<15> The cleaning liquid according to any one of the above aspects <1> to <14>, wherein a content of the polyethylene glycol alkyl ether containing an alkyl group having not less than 8 carbon atoms or the polyethylene glycol aryl ether containing an aryl group having not less than 6 carbon atoms (a-2) in the cleaning liquid is preferably not less than 0.01% by mass, more preferably not less than 0.05% by mass, even more preferably not less than 0.1% by mass and further even more preferably not less than 0.3% by mass, and is also preferably not more than 5% by mass, more preferably not more than 3% by mass, even more preferably not more than 1% by mass and further even more preferably not more than 0.7% by mass.

<16> The cleaning liquid according to any one of the above aspects <1> to <15>, wherein a mass ratio of the acetylene glycol or the ethyleneoxide adduct of the acetylene glycol (a-1) to the polyethylene glycol alkyl ether containing an alkyl group having not less than 8 carbon atoms or the polyethylene glycol aryl ether containing an aryl group having not less than 6 carbon atoms (a-2) [(a-1)/(a-2)] is preferably not less than 0.1, more preferably not less than 0.5 and even more preferably not less than 0.7, and is also preferably not more than 2, more preferably not more than 1.5 and even more preferably not more than 1.3.

<17> The cleaning liquid according to any one of the above aspects <1> to <16>, wherein a total content of the acetylene glycol or the ethyleneoxide adduct of the acetylene glycol (a-1) and the polyethylene glycol alkyl ether containing an alkyl group having not less than 8 carbon atoms or the polyethylene glycol aryl ether containing an aryl group having not less than 6 carbon atoms (a-2) in the surfactant (A) is preferably not less than 80% by mass, more preferably not less than 90% by mass, even more preferably not less than 95% by mass, further even more preferably substantially 100% by mass and still further even more preferably 100% by mass.

<18> The cleaning liquid according to any one of the above aspects <1> to <17>, wherein a content of the water-soluble organic solvent (B) in the cleaning liquid is preferably not less than 5% by mass, more preferably not less than 7% by mass and even more preferably not less than 10% by mass, and is also preferably not more than 30% by mass, more preferably not more than 27% by mass, even more preferably not more than 23% by mass and further even more preferably not more than 17% by mass.

<19> The cleaning liquid according to any one of the above aspects <1> to <18>, wherein a content of diethylene glycol monoisopropyl ether (b-1) in the cleaning liquid is preferably not less than 3% by mass and more preferably not less than 5% by mass, and is also preferably not more than 25% by mass, more preferably not more than 20% by mass, even more preferably not more than 15% by mass and further even more preferably not more than 10% by mass.

<20> The cleaning liquid according to any one of the above aspects <1> to <19>, wherein a mass ratio of the surfactant (A) to diethylene glycol monoisopropyl ether (b-1) [(A)/(b-1)] is preferably not less than 0.01, more preferably not less than 0.03 and even more preferably not less than 0.07, and is also preferably not more than 2, more preferably not more than 1, even more preferably not more than 0.5, further even more preferably not more than 0.3, still further even more preferably not more than 0.2 and furthermore preferably not more than 0.1.

<21> The cleaning liquid according to any one of the above aspects <8> to <20>, wherein a mass ratio of the compound (b-2) to diethylene glycol monoisopropyl ether (b-1) [(b-2)/(b-1)] is preferably not less than 0.03, more preferably not less than 0.05, even more preferably not less than 0.1, further even more preferably not less than 0.2, still further even more preferably not less than 0.3 and furthermore preferably not less than 0.4, and is also preferably not more than 3, more preferably not more than 2, even more preferably not more than 1 and further even more preferably not more than 0.7.

<22> The cleaning liquid according to any one of the above aspects <8> to <21>, wherein a total content of diethylene glycol monoisopropyl ether (b-1) and the compound (b-2) in the water-soluble organic solvent (B) is preferably not less than 80% by mass, more preferably not less than 90% by mass, even more preferably not less than 95% by mass, further even more preferably substantially 100% by mass and still further even more preferably 100% by mass.

<23> The cleaning liquid according to any one of the above aspects <1> to <22>, wherein a content of water in the cleaning liquid is preferably not less than 60% by mass, more preferably not less than 70% by mass and even more preferably not less than 80% by mass, and is also preferably not more than 98% by mass, more preferably not more than 95% by mass, even more preferably not more than 90% by mass and further even more preferably not more than 85% by mass from the viewpoint of improving cleanability for ink.

<24> A method of cleaning a water-based ink including the step of allowing a water-based ink that contains a pigment and a water-insoluble polymer to come into contact with the cleaning liquid according to any one of the above aspects <1> to <23>.

<25> The method of cleaning a water-based ink according to the above aspect <24>, wherein the water-based ink is used for gravure printing or for ink-jet printing.

<26> The method of cleaning a water-based ink according to the above aspect <24> or <25>, wherein the water-insoluble polymer is an acrylic polymer.

<27> A use of the cleaning liquid according to any one of the above aspects <1> to <23> as a cleaning liquid for gravure printing or as a cleaning liquid for ink-jet printing.

EXAMPLES

In the following Examples, Comparative Examples and Production Examples, the "part(s)" and "%" indicate "part(s) by mass" and "% by mass", respectively, unless otherwise specified.

(1) Viscosity of Cleaning Liquid

The viscosity of the cleaning liquid was measured at 25° C. using an E-type viscometer "TV-25" (equipped with a standard cone rotor 1° 34'×R24; rotating speed: 50 rpm) available from Toki Sangyo Co., Ltd.

(2) pH of Cleaning Liquid

The pH value of the cleaning liquid was measured at 25° C. using a bench-top pH meter "F-71" available from Horiba Ltd., equipped with a pH electrode "6337-10D" available from Horiba Ltd.

(3) Weight-Average Molecular Weight of Water-Insoluble Polymer

The molecular weight of the water-insoluble polymer was measured by gel permeation chromatography [GPA apparatus: "HLA-8120GPA" available from Tosoh Corporation; columns: "TSK-GEL, α-M"×2 available from Tosoh Corporation; flow rate: 1 mL/min)] using a solution prepared by dissolving phosphoric acid and lithium bromide in N,N-dimethylformamide such that concentrations of phosphoric acid and lithium bromide in the resulting solution were 60 mmol/L and 50 mmol/L, respectively, as an eluent. Meanwhile, in the aforementioned measurement, monodisperse polystyrenes having known molecular weights were respectively used as a reference standard substance.

Example 1

Production of Cleaning Liquid 1

One gram (1.0 g) of "SURFYNOL 104PG-50" (tradename; a propylene glycol solution of 2,4,7,9-tetramethyl-5-decyne-4,7-diol; active ingredient content: 50%) as the component (a-1) available from Air Products & Chemicals, Inc., was mixed with 0.5 g of a surfactant 2-1 (polyoxyethylene lauryl ether; average molar number of addition of EO: 12 mol) as the component (a-2), 10 g of diethylene glycol monoisopropyl ether as the component (b-1) and 5 g of propylene glycol as the component (b-2), followed by stirring the resulting mixture. Next, 0.2 g of a sodium hydroxide aqueous solution (0.1 N) and 0.02 g of an antiseptic agent "JCL-400" (tradename) available from JOHOKU CHEMICAL Co., Ltd., were added to the mixture, and then ion-exchanged water was added thereto to adjust a whole amount of the resulting mixed solution to 100 g.

The thus obtained mixed solution was passed through a 1.5 μm-mesh filter, thereby obtaining a cleaning liquid 1 (viscosity: 1.25 mPa·s; pH: 9.5).

Examples 2 to 7, Comparative Examples 1 to 6 and Reference Example 1

Production of Cleaning Liquids 2 to 14

The same procedure as in Example 1 was repeated except that the composition formulated was changed as shown in Table 3, thereby obtaining cleaning liquids 2 to 13 (viscosity: 1.05 to 3 mPa·s; pH: 9 to 9.6).

Meanwhile, in Reference Example 1 (cleaning liquid 14), there was used a commercially available cleaning liquid for gravure ink "NT602" (tradename; organic solvent: ethyl acetate) available from TOYO INK Co., Ltd.

Production Example 1

Production of Water-Based Ink (1) Production of Water-Insoluble Polymer Solution The respective components shown in the column "Initially Charged Monomer Solution" in Table 1 were charged into a reaction vessel equipped with two dropping funnels 1 and 2 and mixed with each other, and an inside atmosphere of the reaction vessel was replaced with nitrogen gas, thereby obtaining an initially charged monomer solution.

Next, the respective components shown in each of the columns "Dropping Monomer Solution 1" and "Dropping Monomer Solution 2" in Table 1 were mixed with each other to obtain a dropping monomer solution 1 and a dropping monomer solution 2, respectively. The thus obtained dropping monomer solution 1 and dropping monomer solution 2 were charged into the dropping funnel 1 and the dropping funnel 2, respectively, and an inside atmosphere of each of the dropping funnel 1 and the dropping funnel 2 was replaced with nitrogen gas.

In a nitrogen atmosphere, the initially charged monomer solution in the reaction vessel was maintained at 77° C. while stirring, and the dropping monomer solution 1 in the dropping funnel 1 was gradually added dropwise to the reaction vessel over 3 hours. Next, the dropping monomer solution 2 in the dropping funnel 2 was gradually added dropwise to the reaction vessel over 2 hours. After completion of the dropwise addition, the mixed solution in the reaction vessel was stirred at 77° C. for 0.5 hour.

Then, a polymerization initiator solution prepared by dissolving 1.1 parts of a polymerization initiator "V-65" (tradename; 2,2'-azobis(2,4-dimethylvaleronitrile)) available from Wako Pure Chemical Industries, Ltd., in 47.3 parts of methyl ethyl ketone (hereinafter also referred to merely as "MEK") was added to the mixed solution, and the resulting reaction solution was aged at 77° C. for 0.5 hour while stirring. The aforementioned procedure including the preparation and addition of the polymerization initiator solution and the aging of the reaction solution was repeated twelve more times. Then, while maintaining the reaction solution in the reaction vessel at 80° C. for 1 hour, 8,456 parts of MEK were added thereto to adjust a solid content of the reaction solution to 36%, thereby obtaining a solution of a water-insoluble polymer 1. The weight-average molecular weight of the water-insoluble polymer 1 was 67,000.

Meanwhile, the details of the respective components shown in Table 1 were as follows.

Styrene-based macromer: "AS-6S" (active ingredient content: 50%; number-average molecular weight: 6,000) available from Toagosei Co., Ltd.

NK ESTER M-40G: Methoxy polyethylene glycol monomethacrylate (average molecular weight of addition of EO: 4 mol) available from Shin-Nakamura Chemical Co., Ltd.

V-65: Polymerization initiator "V-65" (tradename; 2,2'-azobis(2,4-dimethylvaleronitrile)) available from Wako Pure Chemical Industries, Ltd.

2-Mercaptoethanol: Chain transfer agent

TABLE 1

| | Initially charged monomer solution (part(s)) | Dropping monomer solution 1 (part(s)) | Dropping monomer solution 2 (part(s)) |
|---|---|---|---|
| Ionic monomer | | | |
| Methacrylic acid | — | 1152 | 288 |
| Hydrophobic monomer | | | |
| Styrene | 396 | 3168 | 396 |
| Styrene-based macromer | 135 | 1215 | — |
| Hydrophilic nonionic monomer | | | |
| NK ESTER M-40G | 225 | 1800 | 225 |
| Methyl ethyl ketone | 157.5 | 1732.5 | 1260 |
| Toluene | 135 | 1215 | — |
| V-65 | — | 72 | 18 |
| 2-Mercaptoethanol | 1.3 | 8.82 | 2.52 |

(2) Production of Water Dispersion of Pigment-Containing Polymer Particles

The resulting water-insoluble polymer 1 solution (solid content: 36%) and MEK were mixed with each other in amounts of 178.7 parts and 45 parts, respectively, thereby obtaining an MEK solution of the water-insoluble polymer 1. The resulting MEK solution of the water-insoluble polymer 1 was charged into a 2 L-capacity disper, and while stirring the solution at 1,400 rpm, 511.4 parts of ion-exchanged water, 22.3 parts of a 5N sodium hydroxide aqueous solution and 1.7 parts of a 25% ammonia aqueous solution were added thereto such that the degree of neutralization of the water-insoluble polymer by sodium hydroxide was adjusted to 78.8 mol % and the degree of neutralization of the water-insoluble polymer by ammonia was adjusted to 21.2 mol %. The resulting reaction solution was stirred at 1,400 rpm for 15 minutes while cooling the solution in a water bath at 0° C.

Then, 150 parts of carbon black "MONARCH717" (tradename) as a black pigment available from Cabot Corporation were added to the reaction solution, and the resulting mixture was stirred at 6,400 rpm for 1 hour. The obtained pigment mixture was subjected to dispersion treatment under a pressure of 150 MPa by passing the mixture through a Microfluidizer "M-7115" available from Microfluidics Corporation 9 times, thereby obtaining a dispersion treatment product (solid content of 25%).

A 2 L eggplant-shaped flask was charged with 324.5 parts of the dispersion treatment product obtained in the above step, and then 216.3 parts of ion-exchanged water were added thereto (solid content: 15%). The resulting mixture was maintained under a pressure of 0.09 MPa in a warm water bath adjusted at 32° 0 for 3 hours using a rotary distillation apparatus "Rotary Evaporator N-1000S" available from Tokyo Rikakikai Co., Ltd., operated at a rotating speed of 50 r/min to remove the organic solvent therefrom. Further, the temperature of the warm water bath was adjusted to 62° C., and the pressure therein was reduced to 0.07 MPa, and the reaction solution was concentrated under this condition until reaching a solid content of 25%.

The thus obtained concentrated solution was charged into a 500 mL angle rotor, and subjected to centrifugal separation using a high-speed cooling centrifuge "himac CR22G" (temperature set: 20° C.) available from Hitachi Koki Co., Ltd., at 7,000 rpm for 20 minutes. Thereafter, the resulting liquid layer portion which was separated by the centrifugal separation was filtered by filtration treatment through a 1.2 μm-mesh filter "MAP-010XS" available from ROKI TECHNO Co., Ltd., thereby recovering a filtrate containing pigment-containing polymer particles 1 (black).

Three hundred parts of the resulting filtrate (pigment: 52.5 parts; water-insoluble polymer 1:22.5 parts) were mixed with 0.68 part of "Ploxel LVS" (mildew-proof agent; active ingredient content: 20%; water content: 80%) available from Arch Chemicals Japan, Inc., and further mixed with 40.23 parts of ion-exchanged water so as to adjust a solid content of the resulting mixture to 22%, followed by stirring the mixture for 1 hour at room temperature, thereby obtaining a water dispersion of the pigment-containing polymer particles 1 (black).

(3) Production of Water Dispersion of Pigment-Free Water-Insoluble Polymer Particles The respective components shown in the column "Initially Charged Monomer Emulsion" in Table 2 were charged into a reaction vessel equipped with a dropping funnel, and mixed with each other, and an inside atmosphere of the reaction vessel was replaced with nitrogen gas, thereby obtaining an initially charged monomer emulsion. In addition, the respective components shown in the column "Dropping Monomer Emulsion" in Table 2 were mixed with each other to obtain a dropping monomer emulsion. The resulting dropping monomer emulsion was charged into the dropping funnel, and an inside atmosphere of the dropping funnel was replaced with nitrogen gas.

In a nitrogen atmosphere, the initially charged monomer emulsion in the reaction vessel was heated from room temperature to 80° C. over 30 minutes while stirring, and then while maintaining the initially charged monomer emulsion in the reaction vessel at 80° C., the dropping monomer emulsion in the dropping funnel was gradually added dropwise to the reaction vessel over 3 hours. After completion of the dropwise addition, the mixed solution in the reaction vessel was stirred for 1 hour while maintaining an inside temperature of the reaction vessel at 80° C. Next, the resulting reaction mixture was filtered through a 200 mesh filter to recover a filtrate containing pigment-free water-insoluble polymer particles 2, thereby obtaining a water dispersion of the pigment-free water-insoluble polymer particles 2 (solid content: 40%). The weight-average molecular weight of the water-insoluble polymer particles 2 was 550,000.

Meanwhile, the details of the respective components shown in Table 2 are as follows.

LATEMUL E-118B: Sodium polyoxyethylenealkylethersulfate as a surfactant available from Kao Corporation Potassium persulfate: Polymerization initiator available from Wako Pure Chemical Industries, Ltd.

TABLE 2

| | Initially charged monomer emulsion (part(s)) | Dropping monomer emulsion (part(s)) |
|---|---|---|
| Ionic monomer | | |
| Methacrylic acid | 0.5 | 9.5 |
| Hydrophobic monomer | | |
| Methyl methacrylate | 14.5 | 275.5 |
| 2-Ethylhexyl acrylate | 5.0 | 95.0 |
| LATEMUL E-118B | 11.1 | 35.1 |
| Ion-exchanged water | 382.8 | 183.0 |
| Potassium persulfate | 0.2 | 0.6 |

(4) Production of Water-Based Ink

The water dispersion of the pigment-containing polymer particles 1 (solid content: 22%) and the water dispersion of the pigment-free water-insoluble polymer particles 2 (solid content: 40%) were used to produce a water-based ink 1. More specifically, ion-exchanged water was added to the mixed water dispersion such that the contents of the pigment and the pigment-free water-insoluble polymer particles 2 in the resulting ink were 5% and 2%, respectively, and then a 1N sodium hydroxide aqueous solution was added to the dispersion such that the pH value of the resulting solution fell within the range of 8.5 to 10.0, and the respective components were compounded with each other at the following compositional ratio, thereby obtaining a mixed solution. The thus obtained mixed solution was filtered through the aforementioned 1.5 μm-mesh filter, thereby obtaining the water-based ink 1.

Meanwhile, the content of the polymer component in the water-based ink 1 was a total content of the water-insoluble polymer 1 and the pigment-free polymer particles 2, i.e., 4.15%, and the content of water in the water-based ink 1 was the balance assuming that the whole amount of the ink was 100%.

<Composition>

| | |
|---|---|
| Water dispersion of pigment-containing polymer particles 1 (having a solid content of 22% and containing 5 parts of the black pigment and 2.15 parts of the water-insoluble polymer 1) | 32.5 parts |
| Water dispersion of pigment-free polymer particles 2 (solid content: 40%) | 5.0 parts |
| Nonionic surfactant (tripropylene glycol monooctyl ether; average molar number of addition of propyleneoxide: 3 mol) available from Kao Corporation | 1.5 parts |
| Propylene glycol | 20.0 parts |
| "SURFYNOL 104PG-50" (a propylene glycol solution of 2,4,7,9-tetramethyl-5-decyne-4,7-diol; active ingredient content: 50%) available from Air Products & Chemicals, Inc., | 2.0 parts |
| "EMULGEN 120" (polyoxyethylene lauryl ether) available from Kao Corporation | 2.0 parts |
| 1N sodium hydroxide aqueous solution | 0.5 part |

Meanwhile, the amount of water compounded was an amount of water contained in the ink whose whole amount was adjusted to 100 parts.

The cleaning liquids 1 to 14 obtained above were evaluated by the following methods. The results are shown in Table 3.

<Evaluation of Cleanability>

After printing characters or images using the water-based ink 1 obtained in Production Example 1, a print head and a gravure printing plate cylinder used for the printing were cleaned with a cleaning liquid, and then an absorbance of the recovered cleaning liquid was measured using an ultraviolet visible spectrophotometer "U-3900" available from Hitachi High-Technologies Corporation to calculate ink cleaning rates according to the following formulae.

(1) Ink Cleaning Rate of Print Head

Separately, the water-based ink 1 of Production Example 1 used in the printing was diluted with the cleaning liquid 10000 times to measure an absorbance of the resulting dilute solution of the ink. The value that was 10000 times the measured absorbance was defined as Abs(B).

An ink-jet printer available from Trytech Co., Ltd., equipped with a print head (adaptable for 30 kHz) available from Kyocera Corporation was charged with 100 mL of the ink obtained in Production Example 1 to print characters or images on 50 sheets of a printing paper. Next, 100 mL of the cleaning liquid was flowed through the print head and then recovered to measure an absorbance of the recovered cleaning liquid. The value of two times the measured absorbance value was defined as Abs(A).

The ink cleaning rate of the print head was calculated according to the following formula (1).

$$\text{Ink Cleaning Rate (\%)}=[\text{Abs(A)}/\text{Abs(B)}]\times 100 \quad (1)$$

(2) Ink Cleaning Rate of Gravure Printing Plate Cylinder

A gravure printing plate cylinder available from Think Laboratory Co., Ltd., to which 10 mL of the ink after used for the printing was deposited was cleaned with 10 L of the cleaning liquid for 1 minute while rotating the cylinder, and then the cleaning liquid used for the cleaning was recovered to measure an absorbance of the recovered cleaning liquid. Since 10 mL of the ink was cleaned with 10 L of the cleaning liquid, the value of 1000 times the measured absorbance value was defined as Abs(C), and the ink cleaning rate of the gravure printing plate cylinder was calculated according to the following formula (2).

Meanwhile, the Abs(B) used in the following formula (2) is the same as that used for calculation of the ink cleaning rate of the print head.

$$\text{Ink Cleaning Rate (\%)}=[\text{Abs(C)}/\text{Abs(B)}]\times 100 \quad (2)$$

(3) Evaluation of Ink Cleaning Rates

The respective ink cleaning rates obtained above were evaluated by six ranks of 0 to 5 according to the following evaluation ratings to determine cleanability of the cleaning liquid for ink. When the rank of the ink cleaning properties according to the following evaluation ratings was 4 or 5, it was indicated that the cleaning liquid had sufficient cleanability for ink and could be used in practical applications. The results are shown in Table 3.

(Evaluation Ratings)

5: Ink cleaning rate was not less than 95%.

4: Ink cleaning rate was not less than 90% and less than 95%.

3: Ink cleaning rate was not less than 85% and less than 90%.

2: Ink cleaning rate was not less than 80% and less than 85%.

1: Ink cleaning rate was not less than 75% and less than 80%.

0: Ink cleaning rate was less than 75%.

The respective asterisked notations, etc., shown in Table 3 are as follows.

*1: Cleaning liquid for gravure ink "NT602" (organic solvent: ethyl acetate) available from TOYO INK Co., Ltd.

*2: The amount of ion-exchanged water compounded was the balance assuming that the whole amount of the cleaning liquid was 100 g.

*3: Content (%) of the water-soluble organic solvent (B) in the cleaning liquid.

[Component (a-1)]

"SURFYNOL 104PG-50" (tradename; a propylene glycol solution of 2,4,7,9-tetramethyl-5-decyne-4,7-diol; active ingredient content: 50%) available from Air Products & Chemicals, Inc.

"SURFYNOL 104" (tradename; 2,4,7,9-tetramethyl-5-decyne-4,7-diol; active ingredient content: 100%) available from Air Products & Chemicals, Inc.

"SURFYNOL 420" (tradename; EO adduct of 2,4,7,9-tetramethyl-5-decyne-4,7-diol; average molar number of addition of EO: 1 mol; active ingredient content: 100%) available from Air Products & Chemicals, Inc.

"SURFYNOL 465" (tradename; EO adduct of 2,4,7,9-tetramethyl-5-decyne-4,7-diol; average molar number of addition of EO: 10 mol; active ingredient content: 100%) available from Air Products & Chemicals, Inc.

"SURFYNOL 485" (tradename; EO adduct of 2,4,7,9-tetramethyl-5-decyne-4,7-diol; average molar number of addition of EO: 30 mol; active ingredient content: 100%) available from Air Products & Chemicals, Inc.

[Component (a-2)]

Surfactant 2-1: Polyoxyethylene lauryl ether (average molar number of addition of EO: 12 mol).

Surfactant 2-2: Polyoxyethylene distyrenated phenyl ether obtained in the following Synthesis Example 1 (average molar number of addition of EO: 13 mol).

Synthesis Example 1

Synthesis of Surfactant 2-2

An autoclave equipped with a stirrer, a temperature controller and an ethyleneoxide inlet device was charged with 608 g (2 mol) of distyrenated phenol available from Kawaguchi Chemical Industry Co., Ltd., and 0.56 g (0.01 mol) of potassium hydroxide, and then an interior of the autoclave was maintained at 110° C. under 1.3 kPa for 30 minutes to remove water therefrom. Thereafter, an inside atmosphere of the autoclave was replaced with nitrogen and heated to 145° C., and then 1144 g (26 mol) of ethyleneoxide was introduced into the autoclave under a pressure (gauge pressure) of 3.5 kg/cm$^2$. The contents of the autoclave were subjected to addition reaction therebetween until reaching a constant pressure at 145° C., and the resulting reaction mixture was aged at 145° C. for 1 hour and then cooled to 80° C. Next, an inorganic alkali adsorbent was charged into the autoclave, and the contents of the autoclave were subjected to filtration treatment to remove potassium hydroxide therefrom, thereby obtaining polyoxyethylene distyrenated phenyl ether (average molar number of addition of EO: 13 mol).

TABLE 3

| | Examples | | | | | | | Comparative Examples | | | | | | Ref. Ex. |
|---|---|---|---|---|---|---|---|---|---|---|---|---|---|---|
| | 1 | 2 | 3 | 4 | 5 | 6 | 7 | 1 | 2 | 3 | 4 | 5 | 6 | 1 |
| Cleaning liquid No. | 1 | 2 | 3 | 4 | 5 | 6 | 7 | 8 | 9 | 10 | 11 | 12 | 13 | 14 |
| Surfactant (A) (g) | | | | | | | | | | | | | | NT602*1 |
| Component (a-1) | | | | | | | | | | | | | | |
| SURFYNOL 104PG-50 | 1.0 | | | 1.0 | 1.0 | 1.0 | 1.0 | 1.0 | | | | | 1.0 | |
| SURFYNOL 104 | | | | | | | | | | | 0.5 | 0.5 | | |
| SURFYNOL 420 | | 1.0 | | | | | | | | | | | | |
| SURFYNOL 465 | | | | | | | 1.0 | | | | | | | |
| SURFYNOL 485 | | | | | | | | | | | 0.5 | 0.5 | | |
| Component (a-2) | | | | | | | | | | | | | | |
| Surfactant 2-1 | 0.5 | 0.5 | 1.0 | 0.5 | | 0.5 | | 0.5 | | 1.0 | | | 0.5 | |
| Surfactant 2-2 | | | | | 0.5 | | | | | | | | | |
| Water-soluble organic solvent (B) (g) | | | | | | | | | | | | | | NT602*1 |
| Component (b-1) | | | | | | | | | | | | | | |
| Diethylene glycol monoisopropyl ether | 10.0 | 10.0 | 10.0 | 20.0 | 5.0 | 10.0 | 10.0 | | 10.0 | | | | | |
| Component (b-2) | | | | | | | | | | | | | | |
| Propylene glycol | 5.0 | 5.0 | 5.0 | 5.0 | | | 5.0 | 5.0 | 5.0 | 5.0 | | | 15.0 | |
| Glycerin | | | | | 10.0 | | | | | | | | | |
| 1,3-Butanediol | | | | | | | | | | | 15.0 | 30.0 | | |
| Diethylene glycol monoethyl ether | | | | | | | | | | | 15.0 | 30.0 | | |
| Diethylene glycol monobutyl ether | | | | | | | | | | 10.0 | | | | |
| Other components (g) | | | | | | | | | | | | | | NT602*1 |
| Sodium hydroxide (0.1N) | 0.2 | 0.2 | 0.2 | 0.2 | 0.2 | 0.2 | 0.2 | 0.2 | 0.2 | 0.2 | 0.2 | 0.2 | 0.2 | |
| Antiseptic agent (JCL-400) | 0.02 | 0.02 | 0.02 | 0.02 | 0.02 | 0.02 | 0.02 | 0.02 | 0.02 | 0.02 | 0.02 | 0.02 | 0.02 | |
| Ion-exchanged water*2 | bal.* | bal.* | bal.* | bal.* | bal.* | bal.* | bal.* | bal.* | bal.* | bal.* | bal.* | bal.* | bal.* | |
| Content (%) of water-soluble organic solvent (B)*3 | 15.5 | 15.0 | 15.0 | 25.5 | 15.5 | 10.5 | 15.5 | 5.5 | 15.0 | 15.0 | 30.0 | 60.0 | 15.5 | Ethyl acetate |
| Mass ratio [(b − 2)/(b − 1)] | 0.55 | 0.5 | 0.5 | 0.28 | 2.1 | 0.05 | 0.55 | — | 0.5 | — | — | — | — | — |

TABLE 3-continued

| | Examples | | | | | | | Comparative Examples | | | | | | Ref. Ex. |
|---|---|---|---|---|---|---|---|---|---|---|---|---|---|---|
| | 1 | 2 | 3 | 4 | 5 | 6 | 7 | 1 | 2 | 3 | 4 | 5 | 6 | 1 |
| Cleanability for ink | | | | | | | | | | | | | | |
| Print head | 5 | 4 | 4 | 4 | 5 | 4 | 4 | 3 | 1 | 3 | 3 | 2 | 3 | 2 |
| Gravure printing plate cylinder | 5 | 5 | 4 | 5 | 5 | 5 | 5 | 3 | 1 | 4 | 3 | 2 | 4 | 2 |

Note
bal.*: Balance

From Table 3, it was confirmed that the cleaning liquids obtained in Examples 1 to 7 in which the surfactant (A) and the water-soluble organic solvent (B) containing diethylene glycol monoisopropyl ether (b-1) were used were excellent in cleanability for ink as compared to the cleaning liquids obtained in Comparative Examples 1 to 6.

The cleaning liquid obtained in Comparative Example 1 in which the water-soluble organic solvent (B) containing diethylene glycol monoisopropyl ether (b-1) was not used was deteriorated in cleanability as compared to the cleaning liquids obtained in Examples 1 to 7.

The cleaning liquid obtained in Comparative Example 2 in which no surfactant (A) was used was deteriorated in cleanability for ink as compared to the cleaning liquids obtained in Examples 1 to 7.

The cleaning liquid obtained in Comparative Example 3 in which diethylene glycol monobutyl ether was used in place of the diethylene glycol monoisopropyl ether (b-1) was deteriorated in cleanability as compared to the cleaning liquid obtained in Example 3.

The cleaning liquids obtained in Comparative Examples 4 and 5 in which the water-soluble organic solvent (B) containing diethylene glycol monoisopropyl ether (b-1) was not used failed to exhibit good cleanability for ink, though the content of the water-soluble organic solvent (B) in the respective cleaning liquids was large.

The cleaning liquid obtained in Comparative Example 6 in which propylene glycol was used in place of the diethylene glycol monoisopropyl ether (b-1) was deteriorated in cleanability as compared to the cleaning liquid obtained in Example 1.

Furthermore, the cleaning liquids obtained in Examples 1 to 7 were superior in cleanability to the commercially available cleaning liquid for gravure printing used in Reference Example 1.

INDUSTRIAL APPLICABILITY

The cleaning liquid of the present invention is excellent in cleanability for ink, and therefore can be suitably used as a cleaning liquid for a water-based ink that contains a pigment and a water-insoluble polymer, in particular, as a cleaning liquid for a water-based ink for gravure printing or a water-based ink for ink-jet printing.

The invention claimed is:

1. A cleaning liquid for a water-based ink that comprises a pigment and a water-insoluble polymer, said cleaning liquid comprising (A) a surfactant, (B) a water-soluble organic solvent comprising (b-1) diethylene glycol monoisopropyl ether, and water, in which the surfactant (A) comprises at least one compound selected from the group consisting of (a-1) an acetylene glycol or an ethyleneoxide adduct of the acetylene glycol, and (a-2) a polyethylene glycol alkyl ether comprising an alkyl group having not less than 8 carbon atoms or a polyethylene glycol aryl ether comprising an aryl group having not less than 6 carbon atoms, the water-soluble organic solvent (B) further comprises (b-2) a compound having a solubility parameter (SP value) of not less than 20 $(MPa)^{1/2}$ and not more than 35 $(MPa)^{1/2}$, the compound (b-2) is a polyhydric alcohol, and a mass ratio of the compound (b-2) to the diethylene glycol monoisopropyl ether (b-1) [(b-2)/(b-1)] is not less than 0.03 and not more than 3, and a content of the water-soluble organic solvent (B) in the cleaning liquid is not less than 7% by mass and not more than 30% by mass, and a content of the diethylene glycol monoisopropyl ether (b-1) in the cleaning liquid is not less than 5% by mass and not more than 25% by mass.

2. The cleaning liquid according to claim 1, wherein an average molar number of addition of ethyleneoxide of the acetylene glycol or the ethyleneoxide adduct of the acetylene glycol (a-1) is not less than 0 mol and not more than 35 mol.

3. The cleaning liquid according to claim 1, wherein the polyethylene glycol alkyl ether comprising an alkyl group having not less than 8 carbon atoms or the polyethylene glycol aryl ether comprising an aryl group having not less than 6 carbon atoms (a-2) is represented by the following formula (1):

$$R^1O-(EO)_n-H \quad (1)$$

wherein $R^1$ is an alkyl group having not less than 8 carbon atoms or an aryl group having not less than 6 carbon atoms; EO is a group derived from ethyleneoxide; and n is an average molar number of addition of EO.

4. The cleaning liquid according to claim 3, wherein the average molar number n of addition of EO in the formula (1) is not less than 4 and not more than 30.

5. The cleaning liquid according to claim 1, wherein the acetylene glycol or the ethyleneoxide adduct of the acetylene glycol (a-1) is used in combination with the polyethylene glycol alkyl ether comprising an alkyl group having not less than 8 carbon atoms or the polyethylene glycol aryl ether comprising an aryl group having not less than 6 carbon atoms (a-2).

6. The cleaning liquid according to claim 5, wherein a mass ratio of the component (a-1) to the component (a-2) [(a-1)/(a-2)] is not less than 0.1 and not more than 2.

7. The cleaning liquid according to claim 1, wherein a mass ratio of the surfactant (A) to the diethylene glycol monoisopropyl ether (b-1) [(A)/(b-1)] is not less than 0.01 and not more than 2.

8. A method of cleaning a water-based ink, comprising the step of allowing the water-based ink that comprises a pigment and a water-insoluble polymer to come into contact with the cleaning liquid according to claim 1.

9. The method of cleaning a water-based ink according to claim 8, wherein the water-based ink is used for gravure printing or ink-jet printing.

10. The method of cleaning a water-based ink according to claim 8, wherein the water-insoluble polymer is an acrylic polymer.

11. The cleaning liquid according to claim 1, wherein a content of the compound (b-2) in the cleaning liquid is not less than 1% by mass and not more than 15% by mass.

12. The cleaning liquid according to claim 1, wherein a total content of diethylene glycol monoisopropyl ether (b-1) and the compound (b-2) in the water-soluble organic solvent (B) is not less than 80% by mass.

13. The cleaning liquid according to claim 1, wherein the compound (b-2) is at least one compound selected from the group consisting of propylene glycol and glycerin.

14. The cleaning liquid according to claim 1, wherein a boiling point of the water-soluble organic solvent (B) is not lower than 150° C. and not higher than 260° C.

15. The cleaning liquid according to claim 1, wherein a total content of the acetylene glycol or the ethyleneoxide adduct of the acetylene glycol (a-1) and the polyethylene glycol alkyl ether containing an alkyl group having not less than 8 carbon atoms or the polyethylene glycol aryl ether containing an aryl group having not less than 6 carbon atoms (a-2) in the surfactant (A) is not less than 80% by mass.

16. The cleaning liquid according to claim 1, wherein a content of the acetylene glycol or the ethyleneoxide adduct of the acetylene glycol (a-1) in the cleaning liquid is not less than 0.01% by mass and not more than 5% by mass.

17. The cleaning liquid according to claim 1, wherein a content of the polyethylene glycol alkyl ether containing an alkyl group having not less than 8 carbon atoms or the polyethylene glycol aryl ether containing an aryl group having not less than 6 carbon atoms (a-2) in the cleaning liquid is not less than 0.01% by mass and not more than 5% by mass.

18. The cleaning liquid according to claim 1, wherein a content of the surfactant (A) in the cleaning liquid is preferably not less than 0.3% by mass and not more than 10% by mass.

* * * * *